US009138795B2

(12) United States Patent
Yogo

(10) Patent No.: US 9,138,795 B2
(45) **Date of Patent: *Sep. 22, 2015**

(54) BENDING DEVICE

(75) Inventor: Teruaki Yogo, Aichi (JP)

(73) Assignee: Kabushiki Kaisha Opton, Seto-shi, Aichi (JP)

( * ) Notice: Subject to any disclaimer, the term of this patent is extended or adjusted under 35 U.S.C. 154(b) by 186 days.

This patent is subject to a terminal disclaimer.

(21) Appl. No.: 13/258,584

(22) PCT Filed: Apr. 8, 2010

(86) PCT No.: PCT/JP2010/056375

§ 371 (c)(1),
(2), (4) Date: Sep. 22, 2011

(87) PCT Pub. No.: WO2010/117037

PCT Pub. Date: Oct. 14, 2010

(65) Prior Publication Data

US 2012/0006088 A1 Jan. 12, 2012

(30) Foreign Application Priority Data

Apr. 8, 2009 (JP) ..... 2009-094094

(51) Int. Cl.
*B21D 7/024* (2006.01)
*B21D 7/12* (2006.01)

(52) U.S. Cl.
CPC . *B21D 7/024* (2013.01); *B21D 7/12* (2013.01)

(58) Field of Classification Search
CPC ..... B21D 7/024; B21D 7/14; B21D 7/022; B21D 7/025; B21D 7/12; B21D 43/105; B21D 7/02; B21D 7/021
USPC ..... 72/306, 307, 149, 311, 157, 156
See application file for complete search history.

(56) References Cited

U.S. PATENT DOCUMENTS

| | | | | |
|---|---|---|---|---|
| 3,431,759 | A * | 3/1969 | Whittingham et al. | 72/422 |
| 4,945,747 | A * | 8/1990 | Yogo | 72/306 |
| 5,873,278 | A * | 2/1999 | Saegusa | 72/306 |
| 6,185,968 | B1 * | 2/2001 | Kanamori | 72/14.8 |

(Continued)

FOREIGN PATENT DOCUMENTS

| | | | |
|---|---|---|---|
| EP | 1 640 078 | A1 | 3/2006 |
| JP | 5-69613 | B | 10/1993 |
| JP | 7-13851 | Y | 4/1995 |
| JP | 2006-116604 | A | 5/2006 |
| JP | 2007-237195 | A | 9/2007 |

OTHER PUBLICATIONS

International Preliminary Report on Patentability issued in International Patent Application No. PCT/JP10/056375 on Nov. 24, 2011.
Extended European Search Report corresponding to European Patent Application No. 10761736.7 dated Dec. 13, 2012.

*Primary Examiner* — Shelley Self
*Assistant Examiner* — Mohammad I Yusuf
(74) *Attorney, Agent, or Firm* — Jenkins, Wilson, Taylor & Hunt, P.A.

(57) ABSTRACT

A bending device is provided with a bending mechanism, a fixing table, an articulated robot, and a control unit. Control performed by the control unit includes a bending/movement control in which a workpiece is moved by clamping the workpiece by the bending mechanism and moving the bending mechanism by the articulated robot, and the workpiece is bent by the bending mechanism while the workpiece is being moved.

5 Claims, 14 Drawing Sheets

(56) References Cited

U.S. PATENT DOCUMENTS

| | | | | |
|---|---|---|---|---|
| 6,189,353 | B1 * | 2/2001 | Kanamori | 72/14.8 |
| 6,237,380 | B1 * | 5/2001 | Kanamori | 72/14.8 |
| 6,694,794 | B2 * | 2/2004 | Crippa | 72/307 |
| 6,854,311 | B2 * | 2/2005 | Schmauder et al. | 72/157 |
| 7,275,406 | B2 * | 10/2007 | Yogo | 72/306 |
| 7,373,797 | B2 * | 5/2008 | Rosenberger | 72/307 |
| 2006/0065034 | A1 | 3/2006 | Yogo | |

* cited by examiner

BENDING DEVICE

CROSS-REFERENCE TO RELATED APPLICATIONS

This application is filed under the provisions of 35 U.S.C. §371 and claims the priority of International Patent Application No. PCT/JP10/056375 filed on Apr. 8, 2010, and of Japanese Patent Application No. 2009-094094 filed on Apr. 8, 2009. The disclosures of said international patent application and Japanese patent application are hereby incorporated by reference herein in their entireties.

TECHNICAL FIELD

The present invention relates to a bending device which moves a bending mechanism around a longitudinal workpiece, such as a pipe or a bar-like material, to bend the workpiece in a predetermined direction.

BACKGROUND ART

A bending device disclosed in Patent Document 1 includes a chuck mechanism that grips a workpiece. Further, the bending device includes an articulated robot having a plurality of bending joints of which bending axes extend in a direction orthogonal to a direction of a link between two members connected with a joint, and a plurality of pivoting joints of which pivoting axes extend in the same direction as the direction of the link between the two members connected with the joint. A bending mechanism is attached to an end of the articulated robot. In this bending device, the robot rotates the respective joints to move the bending mechanism, and moves the workpiece toward the chuck mechanism. While making the chuck mechanism grip the workpiece, the robot rotates the respective joints to move the bending mechanism and bends the workpiece at a plurality of positions.

PRIOR ART DOCUMENT

Parent Document

Patent Document 1: Unexamined Japanese Patent Application Publication No. 2006-116604

DISCLOSURE OF THE INVENTION

Problems to be Solved by the Invention

In the above-described bending device, the workpiece is gripped by the chuck mechanism. Thus, a chuck edge part is required for the gripping by the chuck mechanism. Accordingly, a portion corresponding to the chuck edge part of the workpiece gripped by the chuck mechanism cannot be bent. After the bending, the portion corresponding to the chuck edge part has to be cut. In the above-described bending device, there are problems that the yield ratio is deteriorated and that the cutting operation after the bending is troublesome.

One object of the present invention is to provide a bending device that can improve its yield ratio and can perform bending without requiring a subsequent cutting operation.

Means to Solve the Problems

In order to solve the above problems, a bending device of the present invention includes a bending mechanism, a fixing table, an articulated robot, and a control unit.

The bending mechanism clamps a longitudinal workpiece with a bending die and a clamping die which can be rotated around the bending die, and bends the workpiece by rotating the clamping die. A chuck mechanism that grips the workpiece is mounted on the fixing table. The bending mechanism is attached to the articulated robot. The articulated robot moves the bending mechanism. The control unit controls the articulated robot, the bending mechanism and the chuck mechanism.

Control performed by the control unit includes a bending/movement control in which the workpiece is moved by clamping the workpiece by the bending mechanism and moving the bending mechanism by the articulated robot, and the workpiece is bent by the bending mechanism while the workpiece is being moved.

It is preferable that the articulated robot includes a plurality of bending joints and a plurality of pivoting joints. Bending axes of the bending joints extend in a direction orthogonal to a direction of a link between two members connected with a joint. Pivoting axes of the pivoting joints extend in the same direction as the direction of the link between the two members connected with the joint. Also, the bending/movement control may include a control in which the workpiece is bent by the bending mechanism and gripped by the chuck mechanism, while the workpiece is clamped by the bending mechanism and the bending mechanism is moved by the articulated robot to move the workpiece toward the chuck mechanism.

Or, the bending/movement control may include a control in which the workpiece is bent by the bending mechanism and carried out, while gripping by the chuck mechanism is released with the workpiece being clamped by the bending mechanism and the bending mechanism is moved by the articulated robot to move the workpiece. Further, the bending/movement control may include a control in which the workpiece is gripped by the chuck mechanism, after the workpiece is bent by the bending mechanism while gripping by the chuck mechanism is released with the workpiece being clamped by the bending mechanism and the bending mechanism is moved by the articulated robot to move the workpiece.

Effect of the Invention

The bending device of the present invention can improve its yield ratio and perform bending without cutting operation.

EXPLANATION OF REFERENCE NUMERALS

Figure 1:
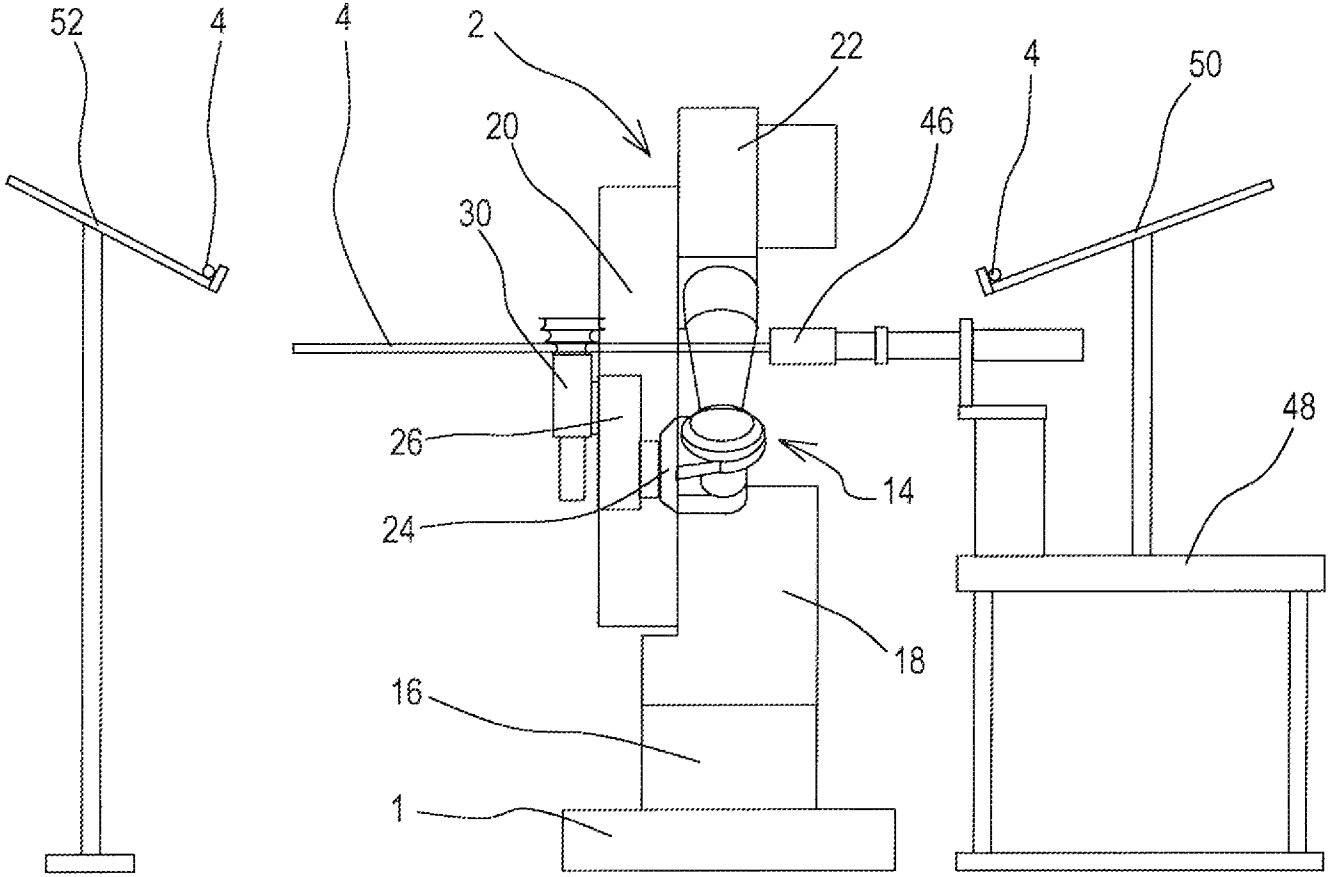
FIG. 1 is a front view of a bending device according to one embodiment of the present invention.
Figure 2:
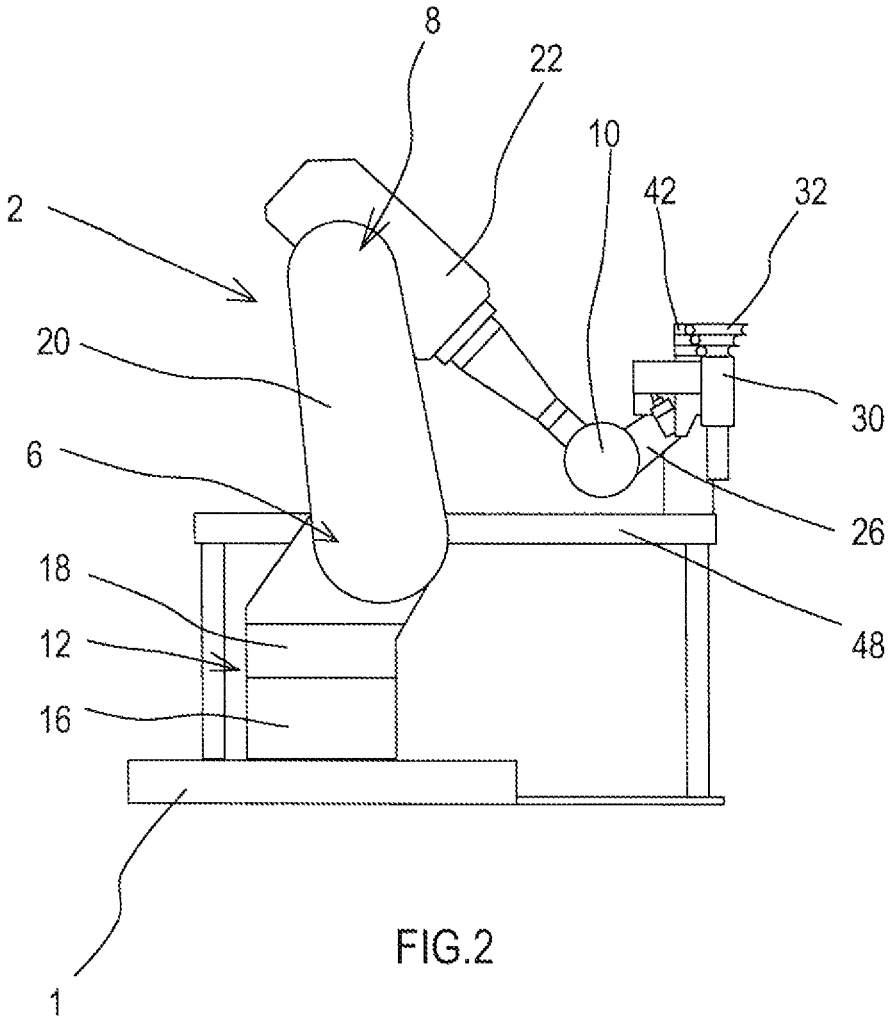
FIG. 2 is a left side view of the bending device according to the embodiment.
Figure 3:
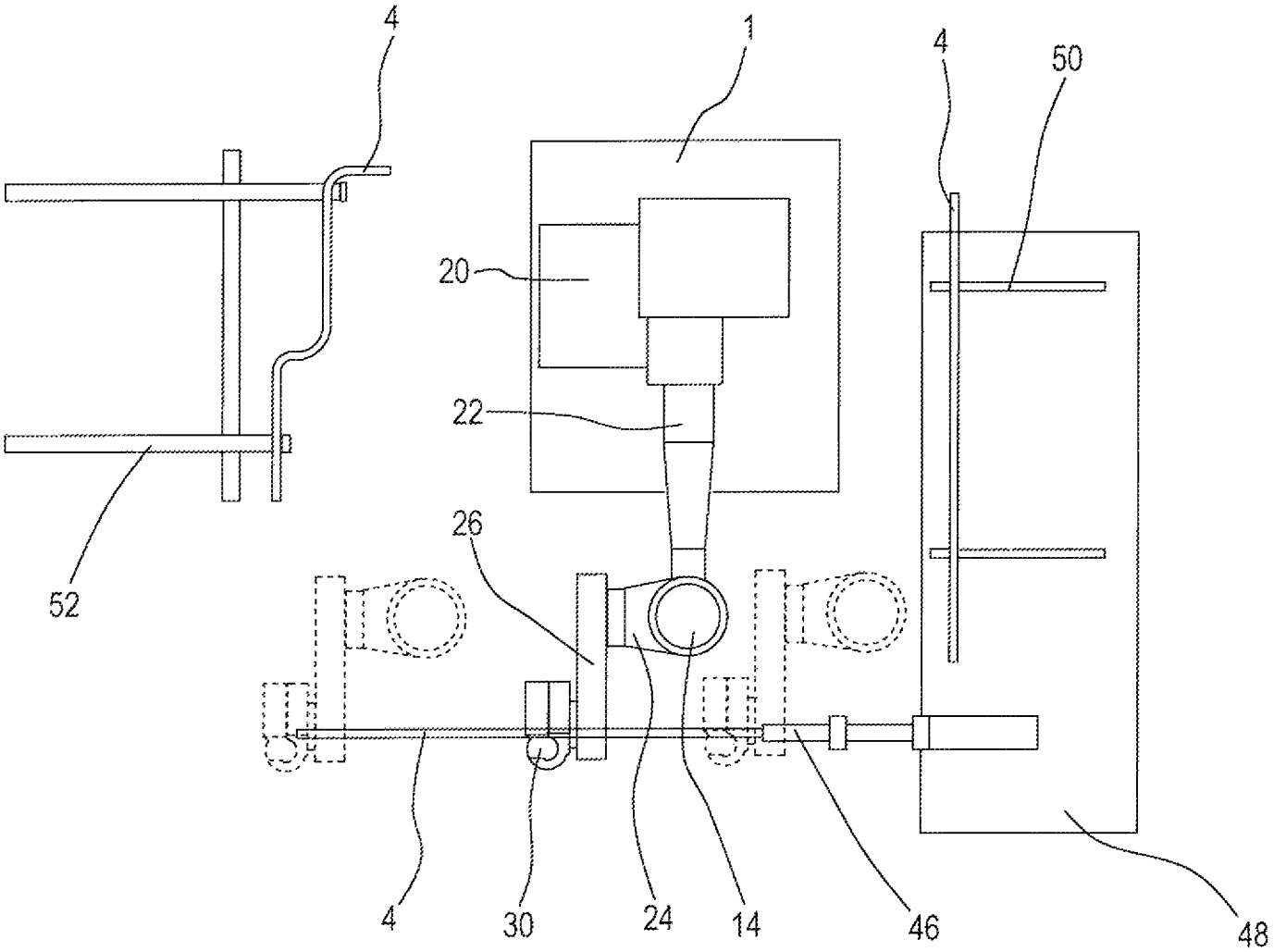
FIG. 3 is a plan view of the bending device according to the embodiment.

| | | | |
|---|---|---|---|
| 1 | machine base | 2 | articulated robot |
| 4 | workpiece | 6, 8, 10 | bending joint |
| 12, 14 | pivoting joint | 30 | bending mechanism |
| 32 | bending die | 42 | clamping die |
| 44 | pressure die | 46 | chuck mechanism |
| 48 | fixing table | 50 | receiving table for carry-in |
| 52 | receiving table for carry-out | 54 | control circuit |

BEST MODE FOR CARRYING OUT THE INVENTION

An embodiment of the present invention will now be explained in detail below based on the drawings. Referring to FIGS. 1 to 4, an articulated robot 2 is mounted on a machine base 1. A later-described bending mechanism 30 that bends a longitudinal workpiece 4 such as a pipe is attached to the articulated robot 2. The articulated robot 2 includes three bending joints, i.e., first to third bending joints 6, 8 and 10, of which bending axes extend in a direction orthogonal to a direction of a link between two members connected with a joint, and two pivoting joints, i.e., first and second pivoting joints 12 and 14, of which pivoting axes extend in the same direction as the direction of the link between the two members connected with the joint.

The articulated robot 2 is provided with a fixing portion 16 mounted on the machine base 1. The fixing portion 16 and a first turning base 18 are connected by the first rotating joint 12. The first pivoting joint 12 has a known mechanism that rotationally drives the first turning base 18 at a predetermined angle around a vertical axis CV1.

One end of a first arm 20 is connected to the first turning base 18 via the first bending joint 6. The first bending joint 6 has a known mechanism that rotationally drives the first arm 20 at a predetermined angle around a horizontal axis CH1. The horizontal axis CH1 of the first bending joint 6 and the vertical axis CV1 of the first pivoting joint 12 cross at right angles.

An other end of the first arm 20 and one end of a second arm 22 is connected via the second bending joint 8. The second bending joint 8 has a known mechanism that rotationally drives the second arm 22 at a predetermined angle around an axis CH2 parallel to the horizontal axis CH1 of the first bending joint 6.

A second turning base 24 is connected to an other end of the second arm 22 via the second pivoting joint 14. The second pivoting joint 14 has a known mechanism that rotationally drives the second turning base 24 at a predetermined angle around an axis CV2 orthogonal to the horizontal axes CH1 and CH2 of the first and second bending joints 6 and 8. One end of a front arm 26 is connected to the second turning base 24 via the third bending joint 10. The third bending joint 10 rotates the front arm 26 around an axis CH3 parallel to the horizontal axes CH1 and CH2 of the first and second bending joints 6 and 8.

Figure 4:
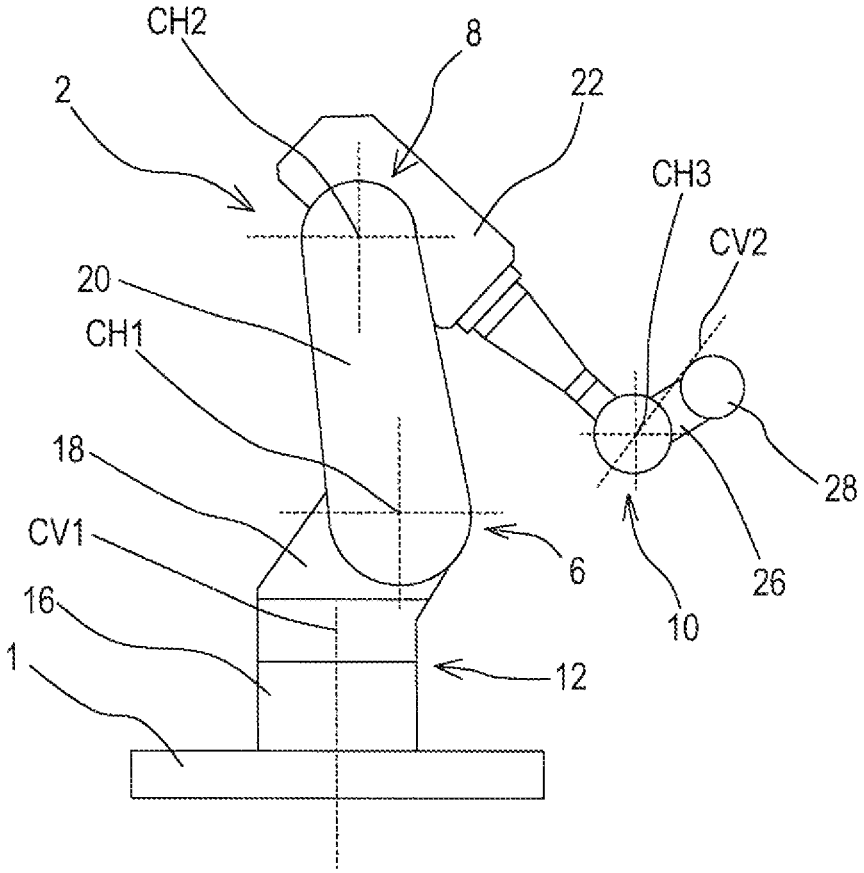
FIG. 4 is a left side view of an articulated robot according to the embodiment.

As shown in FIG. 4, a supplemental joint 28 is provided at a front end of the front arm 26. The bending mechanism 30 is attached to the supplemental joint 28. The supplemental joint 28 is mechanically synchronized with the third bending joint 10. When the third bending joint 10 rotates the front arm 26 by 360°, the supplemental joint 28 rotates the bending mechanism 30 by 360°. The supplemental joint 28 may rotate independently of the third bending joint 10.

Figure 5:
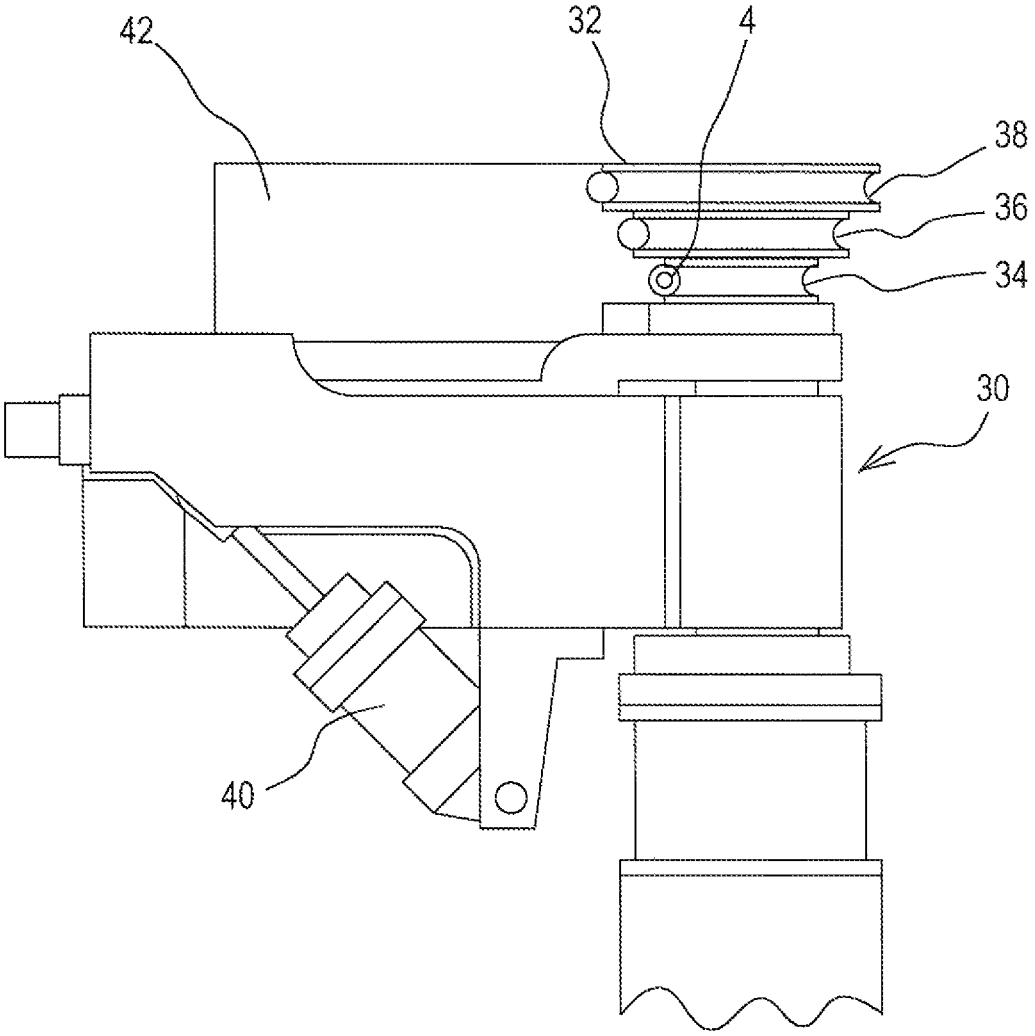
FIG. 5 is an enlarged side view of a bending mechanism according to the embodiment.
Figure 6:
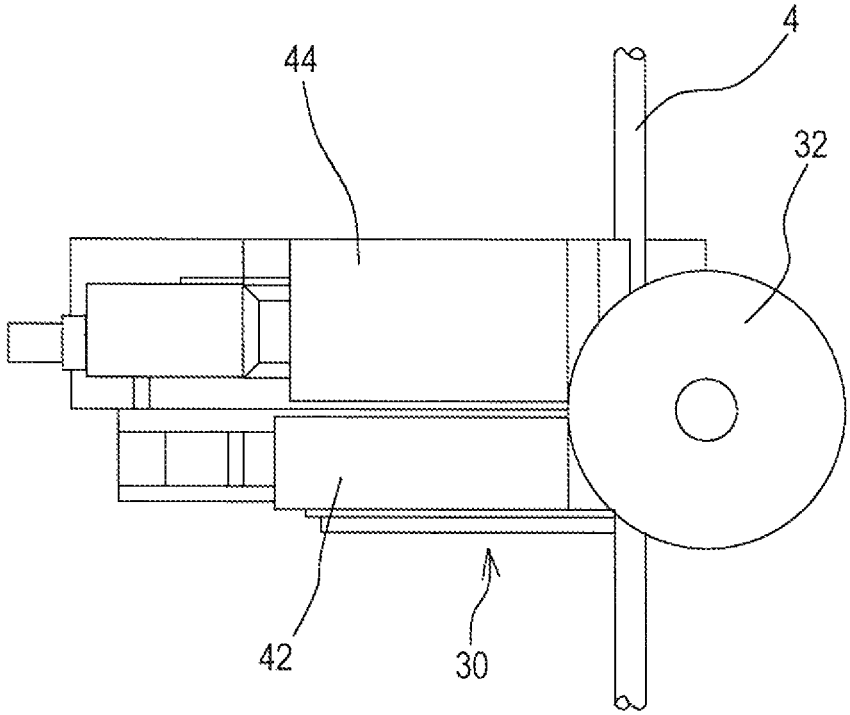
FIG. 6 is an enlarged plan view of the bending mechanism according to the embodiment.

The bending mechanism 30, as shown in FIGS. 5 and 6, includes a bending die 32. The bending die 32 is formed of three grooves 34, 36 and 38 stacked in an axial direction of the bending die 32. The three grooves 34, 36 and 38 correspond to three different bending radii. The bending mechanism 30 also includes a clamping die 42 that is driven by a cylinder 40 to move toward the bending die 32 and clamps the workpiece 4 together with the bending die 32. The clamping die 42 is configured to be able to move around the bending die 32 with the workpiece 4 being clamped. Bending can be achieved by rotating the clamping die 42 at a predetermined angle. A pressure die 44 that receives a reaction force upon bending is provided in line with the clamping die 42. Bending is not limited to compression bending but can be draw bending.

As shown in FIG. 1, a chuck mechanism 46 that grips a rear end of the workpiece 4 is provided. The chuck mechanism 46 is attached to the fixing table 48. The chuck mechanism 46 is configured to grip the workpiece 4 to be horizontal, and to be orthogonal to the vertical axis CV1 of the first pivoting joint 12. Further, on both sides of the articulated robot 2, a receiving table for carry-in 50 and a receiving table for carry-out 52 are respectively provided.

The articulated robot 2 can control a posture and a moving position of the bending mechanism 30, as shown in FIGS. 11A, 11B and 12A to 12E, by rotating the first to third bending joints 6, 8 and 10 and the first and the second pivoting joints 12 and 14.

Figure 11A:
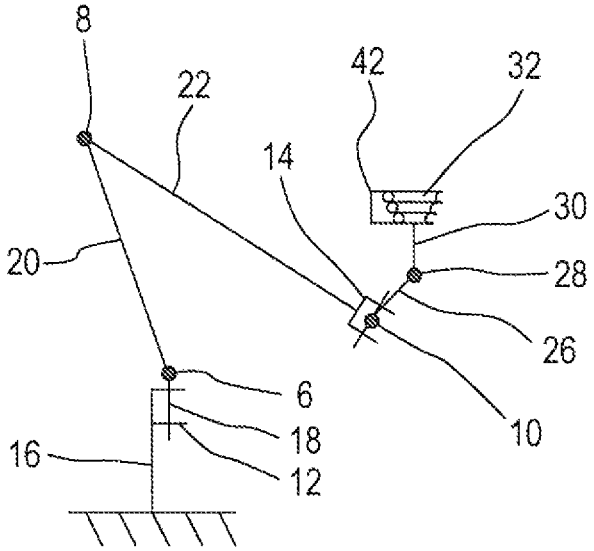
FIG. 11 is an operation explanatory view from a lateral direction of the articulated robot according to the embodiment.
Figure 11B:
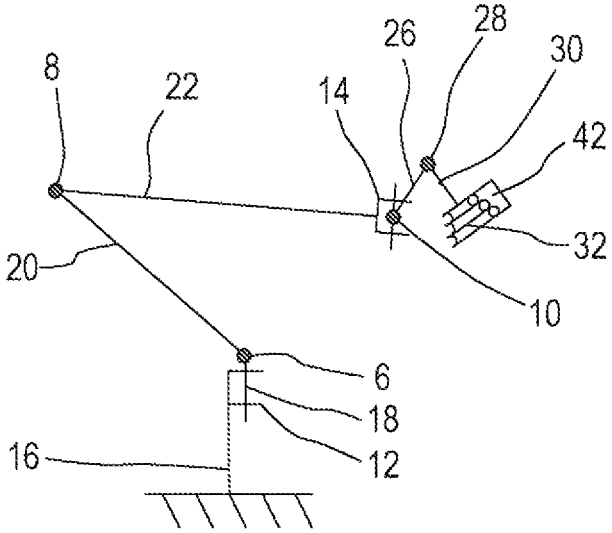

For example, as shown in FIGS. 11A and 11B, the articulated robot 2 can move the bending mechanism 30 so that a bending direction of the workpiece 4 coincides with a direction of the groove 34 of the bending die 32 according to the bending direction of the workpiece 4. In the present embodiment, the third bending joint 10 and the supplemental joint 28 are in a certain synchronizing relation. Thus, if the bending direction is defined, positions of the front arm 26 and the third bending joint 10 are defined by causing the groove 34 to abut on the workpiece 4.

A position of the second bending joint 8 is on an arc around the first bending joint 6, of which radius is a distance between the first bending joint 6 and the second bending joint 8. The position of the second bending joint 8 is also on an arc around the third bending joint 10, of which radius is a distance between the second bending joint 8 and the third bending joint 10. Accordingly, if the second bending joint 8 is in an intersection between the two arcs, a position of the bending die 32 is defined. There may be a case in which two intersections exist. In that case, one of the intersections is selected which does not cause the second arm 22 to interfere with the workpiece 4, and which does not cause a front end of the workpiece 4 after being bent to interfere with the second arm 22.

In this manner, the positions of the respective first to third bending joints 6, 8 and 10 are defined. As a result, an angle formed between the fixing portion 16 and the first arm 20, an angle formed between the first arm 20 and the second arm 22, and an angle formed between the second arm 22 and the front end arm 26 are respectively calculated. According to the respective angles calculated, the first arm 20, the second arm 22 and the front arm 26 are rotated at predetermined angles by the respective first to third bending joints 6, 8 and 10. Thereby, the groove 34 of the bending die 32 is moved to abut on the workpiece 4.

Figure 12A:
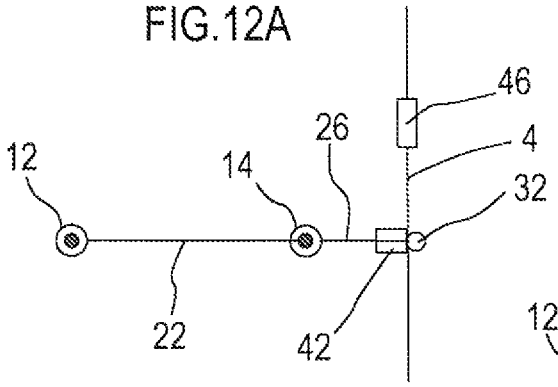
FIG. 12 is an operation explanatory view from a planar direction of the articulated robot according to the embodiment.

As shown in FIG. 12A, when the first arm 20, the second arm 22 and the front arm 26 of the articulated robot 2 are within a plane orthogonal to the workpiece 4, the bending mechanism 30 can be moved around the workpiece 4 by rotating the first to third bending joints 6, 8 and 10 so that the bending direction is set to a predetermined direction, as shown in FIGS. 11A and 11B.

Figure 12B:
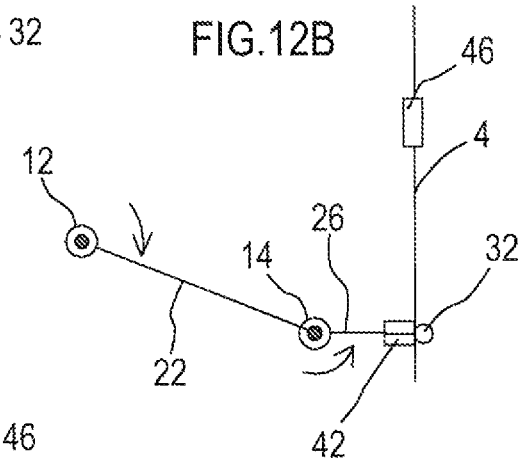

As shown in FIG. 12B, when a bending position is on the front end side of the workpiece 4, the bending mechanism 30 is moved such that the first pivoting joint 12 is driven and the second pivoting joint 14 is driven to the side opposite to the first pivoting joint 12, so that an axial direction of the front arm 26 is orthogonal to the workpiece 4. Also, the first to third bending joints 6, 8 and 10 are driven. When the first pivoting joint 12 is rotated, the bending mechanism 30 is moved away from the workpiece 4. Thus, the first to third bending joints 6, 8 and 10 are driven to make the groove 34 of the bending die 32 abut on the workpiece 4. A bending shape can be changed by making the other grooves 36 and 38 abut on the workpiece 4.

Figure 12C:
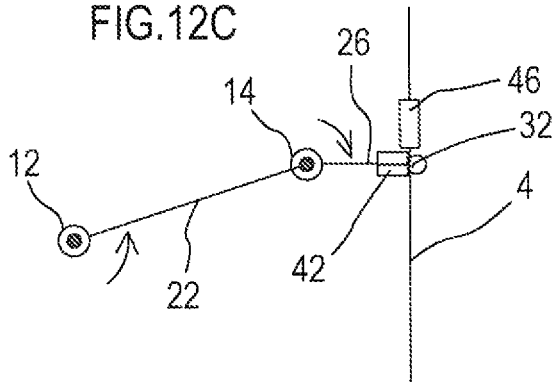

As shown in FIG. 12C, also in the case of bending the workpiece 4 at the bending position close to the chuck mechanism 46, the first pivoting joint 12 is driven to move the bending mechanism 30 to the bending position. In this case, the bending mechanism 30 is moved such that the second pivoting joint 14 is driven to the side opposite to the first pivoting joint 12, so that an axial direction of the front arm 26 is orthogonal to the workpiece 4. Also the first to third bending joints 6, 8 and 10 are driven.

When bending is performed at a plurality of positions, the aforementioned operation is repeated from the bending position at the front end side of the workpiece 4 toward the bending position close to the chuck mechanism 46 to sequentially bend the workpiece 4, as shown in FIG. 12B. With the workpiece being clamped with the bending die 32 and the clamping die 42, the bending mechanism 30 may be rotated around the workpiece 4 and turn the workpiece 4 to change the bending direction. Thereby, the bent workpiece 4 can refrain from interfering with the device and a floor.

Figure 7:
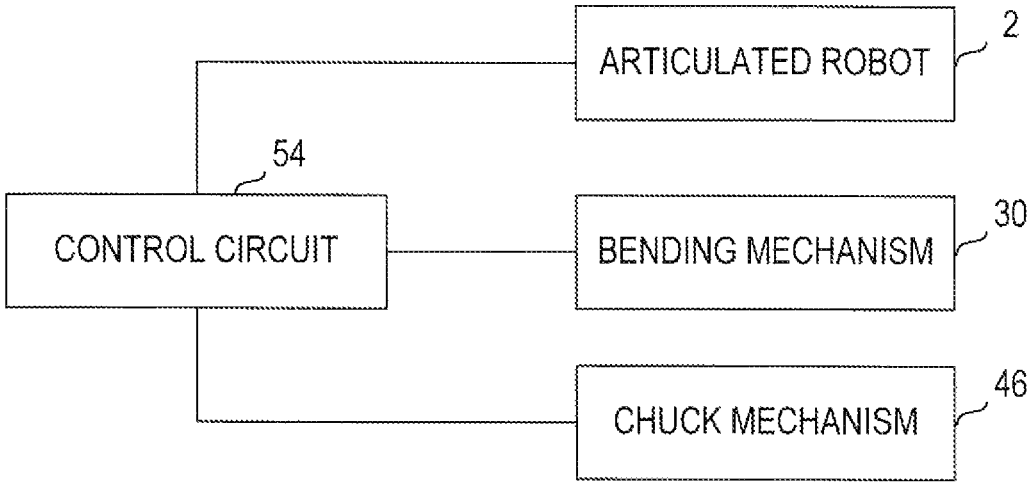
FIG. 7 is a block diagram showing a control system of the bending device according to the embodiment.

The articulated robot 2, the bending mechanism 30, and the chuck mechanism 46 are connected to the control circuit 54 as an example of a control device, as shown in FIG. 7. The control circuit 54 controls driving of the articulated robot 2, the bending mechanism 30, and the chuck mechanism 46, respectively.

Figure 8:
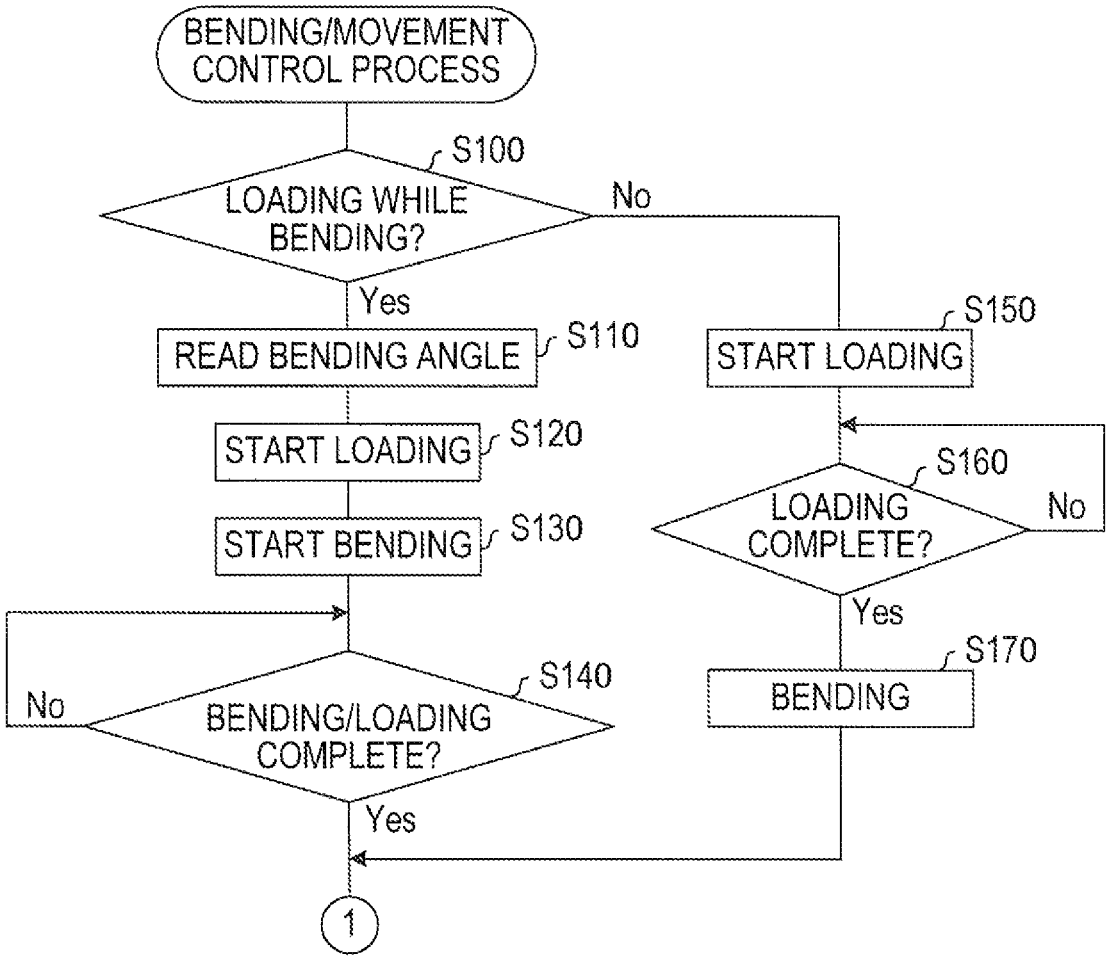
FIG. 8 is a flowchart showing an example of a first part of a bending control process executed in a control circuit according to the embodiment.
Figure 9:
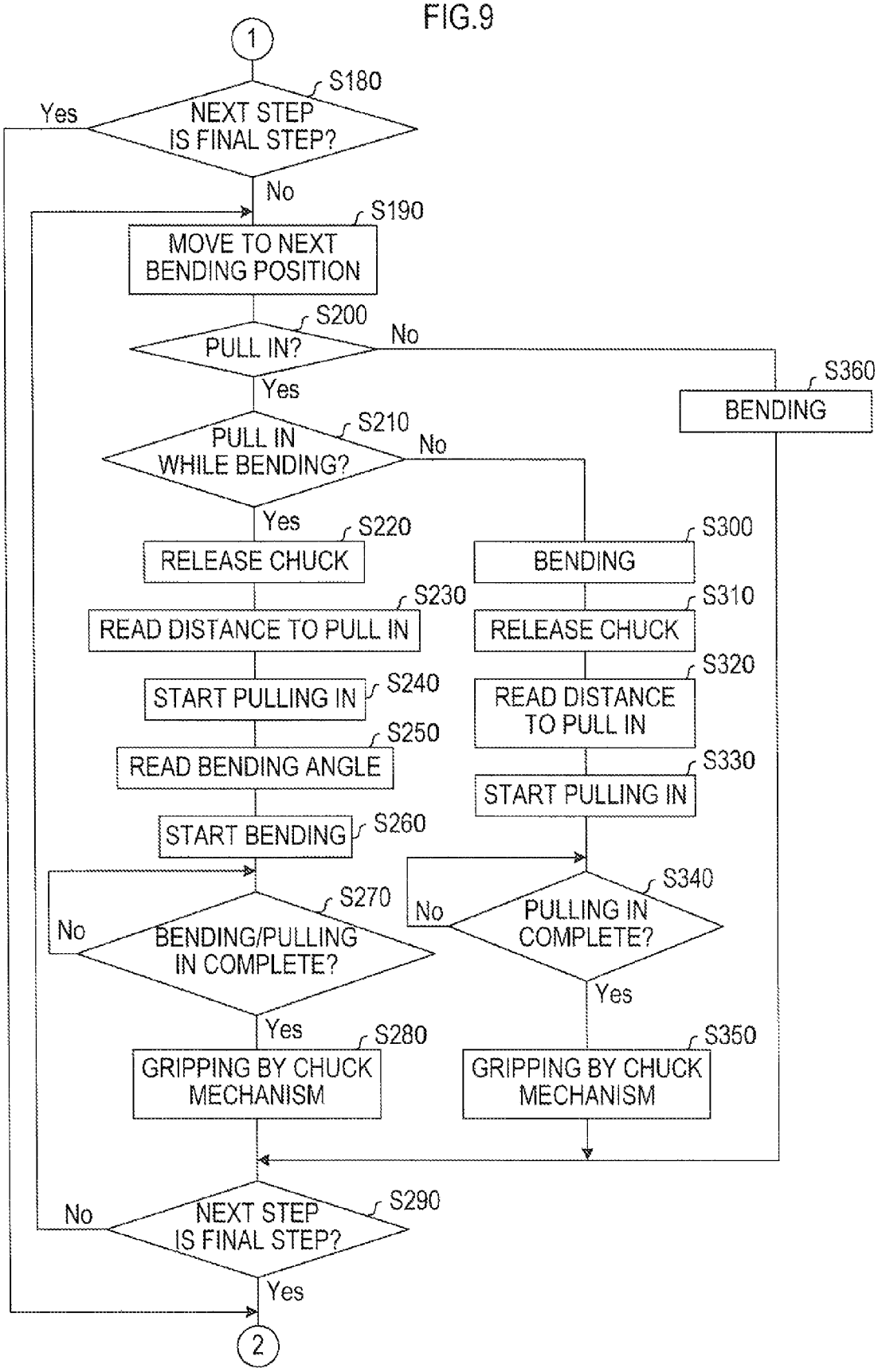
FIG. 9 is a flowchart showing an example of a second part of the bending control process executed in the control circuit according to the embodiment.
Figure 10:
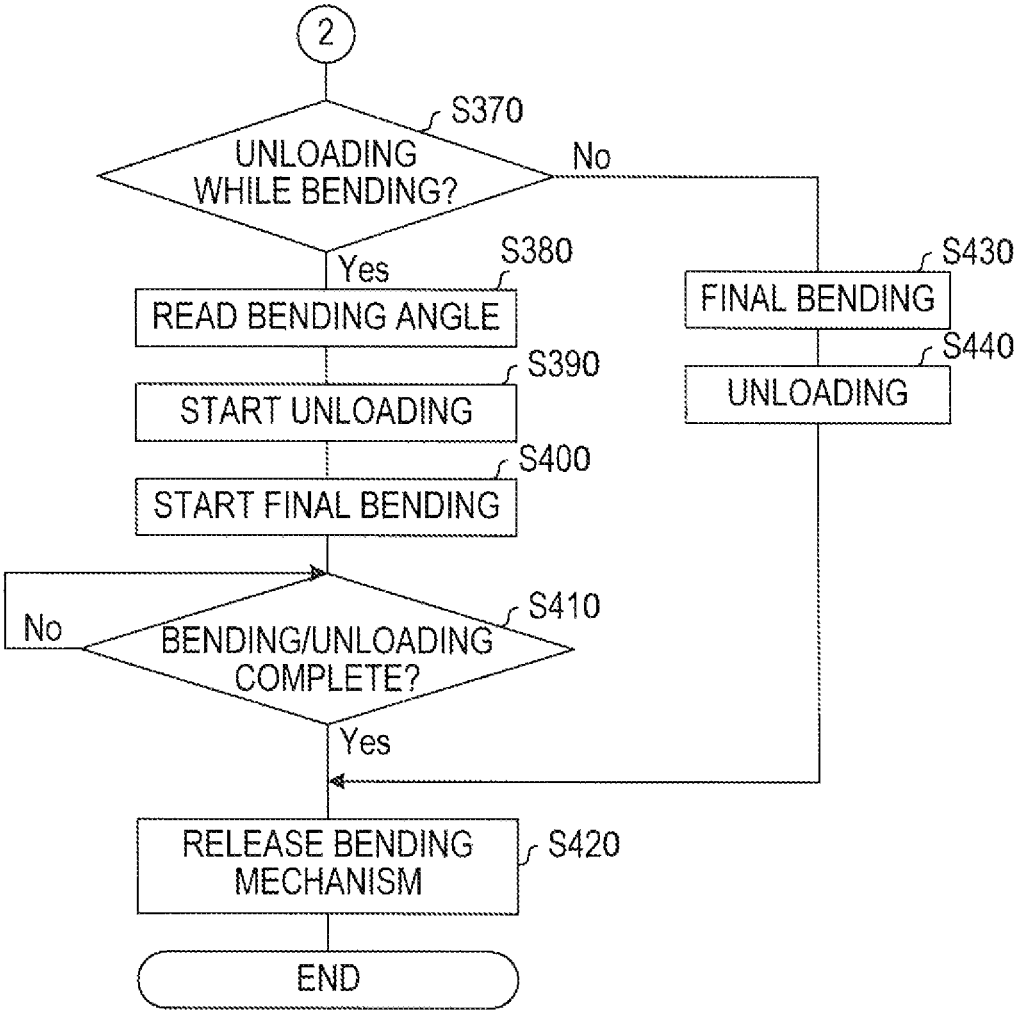
FIG. 10 is a flowchart showing an example of a third part of the bending control process executed in the control circuit according to the embodiment.

Now, referring to the flowcharts shown in FIGS. 8 to 10 illustrating a flow of a bending control process performed in the control circuit 54, operation of the aforementioned bending device of the present embodiment will be described.

First, the workpiece 4 which has been cut into a predetermined length is conveyed onto the receiving table for carrying-in 50. When the bending control process is started, it is determined whether or not to perform loading while bending the workpiece 4 (S100 (S means a step)). Whether or not to perform loading while bending is already set as bending data. Such bending data is preset in case that the bending position of the workpiece 4 is located in a position where bending is unable to be performed or is difficult to be performed with the workpiece 4 being gripped by the chuck mechanism 46. Or, the bending data is set when a bracket or the like is attached to the workpiece 4 prior to bending and there is certain limitation in gripping the workpiece 4 by the chuck mechanism 46.

If loading is performed while bending, a bending angle for the bending mechanism 30 is read from the bending data (S110). Then, the workpiece 4 is to be clamped by the bending mechanism 30 and the loading is started which moves the workpiece 4 toward the chuck mechanism 46 in order to make the chuck mechanism 46 grip the workpiece 4 (S120).

Figure 12D:
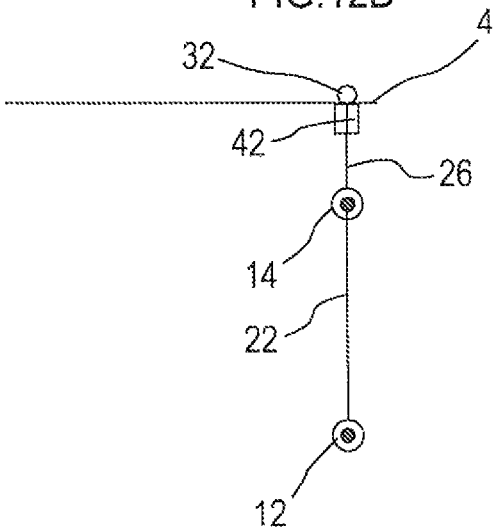
Figure 12E:
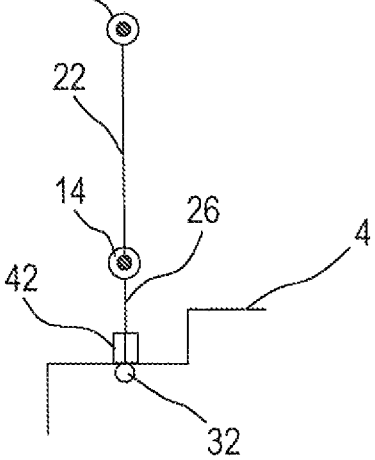

Upon the loading, as shown in FIG. 12D, the first pivoting joint 12 of the articulated robot 2 is driven so that the articulated robot 2 faces the workpiece 4 on the receiving table for carry-in 50. Also, the first to third bending joints 6, 8 and 10 of the articulated robot 2 are driven to move the bending mechanism 30 so as to make the workpiece 4 abut on the groove 34 of the bending die 32.

Next, the clamping die 42 and the pressure die 44 are moved to clamp the workpiece 4 by the bending mechanism 30. After the workpiece 4 is clamped by the bending mechanism 30, the articulated robot 2 is controlled to drive the respective first to third bending joints 6, 8 and 10 and first and second pivoting joints 12 and 14 to move the workpiece 4 toward the chuck mechanism 46. When the workpiece 4 is clamped by the bending mechanism 30, the bending portion to be bent at the bending angle read in S110 is clamped by the bending mechanism 30.

Figure 13:
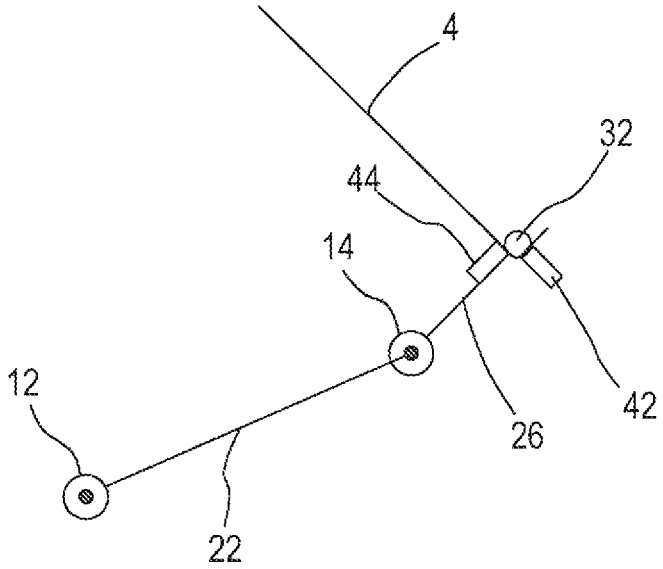
FIG. 13 is an operation explanatory view from the planar direction of the articulated robot according to the embodiment upon loading while bending.

While moving the workpiece 4 toward the chuck mechanism 46 by the loading, the bending mechanism 30 is driven to start bending of the workpiece 4 (S130). As shown in FIG. 13, bending is performed by moving the clamping die 42 around the bending die 32 according to the bending angle read in S110. Even during the bending, the respective first to third bending joints 6, 8 and 10 and first and second pivoting joints 12 and 14 are driven to move the workpiece 4 toward the chuck mechanism 46. During the loading, the move of the workpiece 4 may be temporarily stopped to perform the bending.

Upon loading, as shown in FIG. 12A, the workpiece 4 on the receiving table for carry-in 50 is moved toward the chuck mechanism 46 so that the workpiece 4 can be gripped by the chuck mechanism 46. After the workpiece 4 is moved to the chuck mechanism 46 and inserted to the chuck mechanism 46, the chuck mechanism 46 is controlled to grip the workpiece 4. It is then determined whether or not the bending and loading has been complete (S140). If not complete, completion of the bending and loading is awaited.

When it is determined in the aforementioned S100 that the loading is not performed during bending, the loading is started in the same manner as in S120 (S150). After the loading is complete and it is determined that the workpiece 4 is gripped by the chuck mechanism 46 (S160), the bending is performed next in the same manner as in S110 and S130 (S170).

When the first bending is complete in the aforementioned S140 and S170, it is determined whether or not the next step is final bending (S180). If there are three or more of portions to be bent, it is determined that the current step is not final bending. The articulated robot 2 is controlled to move the bending mechanism 30 to the next bending position of the workpiece 4, drive the clamping die 42 and the pressure die 44, make the clamping die 42 and the pressure die 44 abut on the workpiece 4, and clamp the workpiece 4 by the bending mechanism 30 (S190).

Figure 14A:
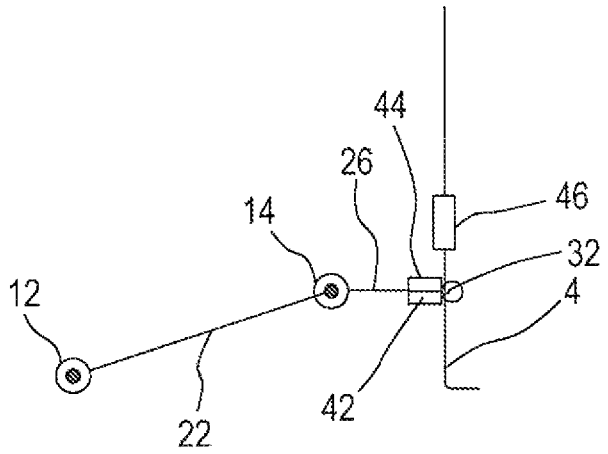
FIG. 14 is an operation explanatory view from the planar direction of the articulated robot according to the embodiment upon drawing in while bending.

Next, it is determined based on the preset bending data whether or not to pull in the workpiece 4 (S200). As shown in FIG. 14A, when the bending mechanism 30 is moved to the next bending portion of the workpiece 4 gripped by the chuck mechanism 46, the chuck mechanism 46 and the bending mechanism 30 get close to each other. Upon the next bending, the workpiece 4 has to be pulled in from the chuck mechanism 46.

In this case, it is determined to pull in the workpiece 4. Next, it is determined whether or not to pull in the workpiece 4 while bending the workpiece 4 (S210). As shown in FIG. 14A, if the chuck mechanism 46 and the bending mechanism 30 do not interfere even if the bending mechanism 30 is moved to the next bending position, the workpiece 4 is pulled in while being bent.

Gripping of the workpiece 4 by the chuck mechanism 46 is then released (S220). Data indicating a distance to pull in the workpiece 4 is read (S230). The distance to pull in is preset in the bending data. Next, the respective first to third bending joints 6, 8 and 10 and the first and second pivoting joints 12 and 14 are driven to move the bending mechanism 30 in a longitudinal direction of the workpiece 4 and start pulling in (S240). Thereby, the workpiece 4 is moved in the longitudinal direction to be pulled in from the chuck mechanism 46.

Next, the bending angle by the bending mechanism 30 is read (S250). The bending mechanism 30 is driven to start bending of the workpiece 4 (S260). Bending is performed by moving the clamping die 42 around the bending die 32 according to the bending angle read in S250. Even while the bending, the respective first to third bending joints 6, 8 and 10 and the first and second pivoting joints 12 and 14 are driven to pull in the workpiece 4 from the chuck mechanism 46.

Figure 14B:
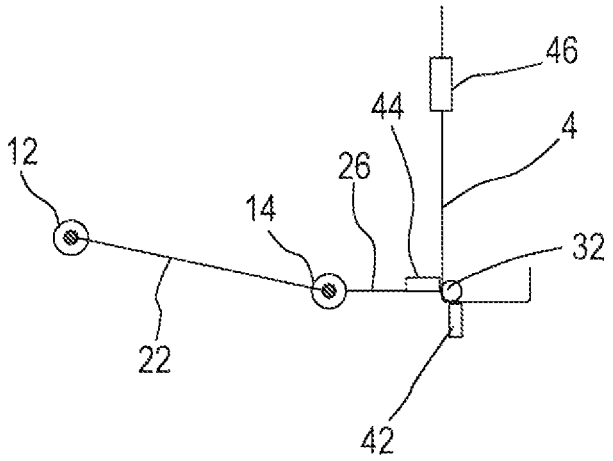

It is then determined whether or not the bending and pulling in have been complete (S270). If not, completion of the bending and pulling in are awaited. As shown in FIG. 14B, when the bending and the pulling in are complete, the workpiece 4 is gripped by the chuck mechanism 46 (S280).

It is then determined whether or not the next step is final bending (S290). If not, S190 and the subsequent steps are repeated. The respective first to third bending joints 6, 8 and 10 and the first and second pivoting joints 12 and 14 are driven to move the bending mechanism 30 to the next bending position.

If it is determined that pulling in of the workpiece 4 is not to be performed during the bending of the workpiece 4, the clamping die 42 is moved around the bending die 32 according to the preset bending angle to perform bending (S300).

Next, gripping of the workpiece 4 by the chuck mechanism 46 is released (S310). The distance to pull in the workpiece 4 is read (S320). Next, the respective first to third bending joints 6, 8 and 10 and the first and second pivoting joints 12 and 14 are driven to move the bending mechanism 30 in the longitudinal direction of the workpiece 4 and start pulling in (S330). Thereby, the workpiece 4 is moved in the longitudinal direction and pulled in from the chuck mechanism 46.

It is then determined whether or not pulling in has been complete (S340). If not, completion of pulling in is awaited. When pulling in is complete, the workpiece is gripped by the chuck mechanism 46 (S350) to execute S290.

When it is determined that pulling in of the workpiece 4 is not to be performed in the aforementioned S200, the clamping die 42 is moved around the bending die 32 according to the preset bending angle to perform bending (S360). Then, S290 is executed.

If the next step is not the final step, S190 and the subsequent steps are repeated. The bending mechanism 30 is moved to the bending position to bend the workpiece 4. Data on the bending position is preset in the bending data. If the next step is the final step, it is determined whether or not to perform unloading while bending (S370). Data on whether or not to perform unloading while bending is preset in the bending data. For example, if the bending position of the workpiece 4 is located in a position where bending is unable to be performed or is difficult to be performed with the workpiece 4 being gripped by the chuck mechanism 46, unloading is performed while bending. Or, when a bracket or the like is attached to the workpiece 4 prior to bending and there is certain limitation in gripping of the workpiece 4 by the chuck mechanism 46, unloading is performed while bending.

In case that unloading is performed while bending, the bending angle by the bending mechanism 30 is read (S380). Then, the workpiece 4 is clamped by the bending mechanism 30 to release the chuck mechanism 46, and moved toward the receiving table for carry-out 52, so that unloading is started (S390).

Upon unloading, the respective first to third bending joints 6, 8 and 10 and the first and second pivoting joints 12 and 14 of the articulated robot 2 are driven to move the bending mechanism 30 to make the workpiece 4 abut on the groove 34 of the bending die 32.

Next, the clamping die 42 and the pressure die 44 are moved to clamp the workpiece 4 by the bending mechanism 30. After the workpiece 4 is clamped by the bending mechanism 30, the articulated robot 2 is controlled to drive the respective first to third bending joints 6, 8 and 10 and the first and second pivoting joints 12 and 14 to move the workpiece 4 toward the receiving table for carry-out 52. Upon clamping the workpiece 4 by the bending mechanism 30, the bending portion is clamped by the bending mechanism 30.

While the workpiece 4 is moved toward the receiving table for carry-out 52 by unloading, the bending mechanism 30 is driven to start final bending of the workpiece 4 (S400). Bending is performed by moving the clamping die 42 around the bending die 32 according to the bending angle read in S380. During the bending, the respective first to third bending joints 6, 8 and 10 and the first and second pivoting joints 12 and 14 are driven to move the workpiece 4 toward the receiving table for carry-out 52. During the unloading, the move of the workpiece 4 may be temporarily stopped to perform bending.

It is then determined whether or not the bending and unloading has been complete (S410). If not, completion of the bending and unloading is awaited. When the bending and unloading are complete, clamping of the workpiece 4 by the bending mechanism 30 is released and the workpiece 4 is placed on the receiving table for carry-out 52 (S420). The present control process is ended.

If it is determined that unloading is not to be performed during bending, the articulated robot 2 is controlled to move the bending mechanism 30 to a final bending position, and thereafter drives the clamping die 42 and the pressure die 44 to make the clamping die 42 and the pressure die 44 abut on the workpiece 4 and make the clamping die 42 move around the pressure die 44 at a predetermined bending angle so as to perform final bending (S430).

The articulated robot 2 is controlled to move the bending mechanism 30, for example, to a position where the right and left balance of the workpiece 4 after bent can be maintained. The clamping die 42 of the bending mechanism 30 is driven to clamp the workpiece 4 with the clamping die 42 and the bending die 32. The chuck mechanism 46 is then released. Unloading is performed which moves the workpiece 4 toward the receiving table for carry-out 52 (S440). After the workpiece 4 is moved over the receiving table for carry-out 52, clamping of the workpiece 4 by the bending mechanism is released to place the workpiece 4 on the receiving table for carry-out 52 (S420). The control process is ended.

As noted above, loading while bending, pulling in while bending, or unloading while bending is executed. Thus, work efficiency is improved. With the workpiece 4 being gripped by the chuck mechanism 46, bending can be performed even at a position where bending is generally impossible. Also, cutting, etc. after the bending is unnecessary. The yield ratio can be improved.

The present invention should not be limited to the above described embodiment, and can be practiced in various forms within the scope not departing from the gist of the present invention.

The invention claimed is:

1. A bending device comprising:

a bending mechanism that clamps a longitudinal workpiece with a bending die and a clamping die that can be rotated around the bending die, and bends the workpiece by rotating the clamping die;

a fixing table on which a chuck mechanism that grips the workpiece is mounted;

an articulated robot to which the bending mechanism is attached and which moves the bending mechanism; and a control unit that controls the articulated robot, the bending mechanism and the chuck mechanism, wherein control performed by the control unit includes a bending/movement control in which the workpiece is moved by clamping the workpiece by the bending mechanism and moving the bending mechanism by the articulated robot, and the workpiece is bent by the bending mechanism while an entirety of the workpiece is being moved in a state of being separated from the chuck mechanism, and wherein the control unit includes a storage device to store data, for each type of the workpiece, indicating whether or not to perform the bending/movement control, and reads the data from the storage device and performs the bending/movement control in accordance with contents of the data.

2. The bending device according to claim 1, wherein the articulated robot includes:

a plurality of bending joints, bending axes of the bending joints extending in a direction orthogonal to a direction of a link between two members connected with a joint;

a plurality of pivoting joints, pivoting axes of the pivoting joints extending in the same direction as the direction of the link between the two members connected with the joint.

3. The bending device according to claim 1, wherein the bending/movement control includes a control in which the workpiece is clamped by the bending mechanism, and the workpiece is bent by the bending mechanism while the bending mechanism is moved by the articulated robot to move the workpiece toward the chuck mechanism, and then the workpiece is gripped by the chuck mechanism.

4. The bending device according to claim 1, wherein the bending/movement control includes a control in which gripping by the chuck mechanism is released with the workpiece being clamped by the bending mechanism, the workpiece is bent by the bending mechanism while the bending mechanism is moved by the articulated robot to move the workpiece, and then the workpiece is unloaded from the bending device.

5. The bending device according to claim 1, wherein the bending/movement control includes a control in which gripping by the chuck mechanism is released with the workpiece being clamped by the bending mechanism, the workpiece is bent by the bending mechanism while the bending mechanism is moved by the articulated robot to move the workpiece, and then the workpiece is gripped by the chuck mechanism.

* * * * *